US010476238B2

(12) United States Patent
Kaji

(10) Patent No.: US 10,476,238 B2
(45) Date of Patent: Nov. 12, 2019

(54) SPARK PLUG FOR INTERNAL COMBUSTION ENGINE

(71) Applicant: DENSO CORPORATION, Kariya, Aichi-pref. (JP)

(72) Inventor: Yuji Kaji, Kariya (JP)

(73) Assignee: DENSO CORPORATION, Kariya (JP)

( * ) Notice: Subject to any disclaimer, the term of this patent is extended or adjusted under 35 U.S.C. 154(b) by 0 days.

(21) Appl. No.: 16/214,505

(22) Filed: Dec. 10, 2018

(65) Prior Publication Data

US 2019/0181620 A1 Jun. 13, 2019

(30) Foreign Application Priority Data

Dec. 12, 2017 (JP) ..... 2017-237916

(51) Int. Cl.

| | |
|---|---|
| ***H01T 13/16*** | (2006.01) |
| ***H01T 13/40*** | (2006.01) |
| ***H01T 13/38*** | (2006.01) |
| ***H01T 13/34*** | (2006.01) |

(52) U.S. Cl.

CPC ..... *H01T 13/16* (2013.01); *H01T 13/34* (2013.01); *H01T 13/38* (2013.01); *H01T 13/40* (2013.01)

(58) Field of Classification Search

CPC ..... H01T 13/16; H01T 13/34; H01T 13/38; H01T 13/40; H01T 21/02

See application file for complete search history.

(56) References Cited

U.S. PATENT DOCUMENTS

| | | | | |
|---|---|---|---|---|
| 2,586,864 | A * | 2/1952 | Rose | H01T 13/467 313/139 |
| 9,653,887 | B1 * | 5/2017 | Niessner | H01T 13/16 |
| 2016/0064903 | A1 * | 3/2016 | Deguchi | H01T 13/32 313/120 |
| 2017/0077679 | A1 * | 3/2017 | Deguchi | H01T 13/16 |
| 2017/0077682 | A1 | 3/2017 | Deguchi et al. | |

* cited by examiner

*Primary Examiner* — Mariceli Santiago

(74) *Attorney, Agent, or Firm* — Nixon & Vanderhye P.C.

(57) ABSTRACT

A spark plug for internal combustion engines is provided which includes a porcelain insulator which is disposed inside a housing and extends outside a front end of the porcelain insulator. An annular ground electrode is secured to a front end portion of the housing. A pocket is created between a nose of the porcelain insulator and the housing. The housing has formed therein a plurality of vent holes which are located outside the ground electrode in a radial direction of the housing and communicate between the pocket and a combustion chamber of the engine. The vent holes include a first vent hole and a second vent hole which are different in opening area from each other, thereby enhancing scavenging of the pocket to ensure the stability of operation of the spark plug.

7 Claims, 10 Drawing Sheets

SPARK PLUG FOR INTERNAL COMBUSTION ENGINE

CROSS REFERENCE TO RELATED DOCUMENT

The present application claims the benefit of priority of Japanese Patent Application No. 2017-237916 filed on Dec. 12, 2017 the disclosure of which is incorporated herein by reference.

BACKGROUND

1. Technical Field

This disclosure relates generally to a spark plug for internal combustion engines.

2. Background Art

There is a need for increasing the service life of spark plugs for use with internal combustion engines against mechanical wear thereof. For instance, Japanese Patent First Publication No. 2017-059364 teaches a spark plug equipped with a center electrode and a ground electrode. The center electrode is arranged inside a hollow cylindrical porcelain insulator 3 coaxially therewith and retained by a housing. The center electrode has a tip protruding outside the front end of the housing. The ground electrode is attached to the front end of the housing and faces an outer periphery of the tip of the center electrode. The center electrode and the ground electrode are arranged to have an annular spark gap therebetween in which a sequence of sparks are created. A pocket is formed between an outer peripheral surface of a tip portion of the porcelain insulator 3 and the housing. The housing has formed in a front portion thereof a vent hole which establishes communication between a combustion chamber of the engine and the pocket, thereby enhancing scavenging of the pocket that is, reducing the amount of residual gas accumulated in the pocket for improving the ability of the spark plug to ignite the fuel.

Recent years, some internal combustion engines have been designed for lean-burning in order to provide better performance and efficient fuel use. The lean-burning usually result in a decrease in combustion temperature, so that the fuel may smolder, which leads to a concern about soot. The structure in the above publication is designed to discharge exhaust emissions through the vent hole to enhance the efficiency in scavenging the gas from the pocket to eliminating the smoldering to minimize the soot. The gas is, however, scavenged in an axial direction of the spark plug, thereby causing the gas to flow in the axial direction within the pocket. There is, therefore, still room for improvement in scavenging the pocket.

SUMMARY

It is an object of this disclosure to provide a spark plug which is designed to improve scavenging of a pocket created between a porcelain insulator and a housing.

According to one aspect of the disclosure, there is provided a spark plug for an internal combustion engine which comprises: (a) a hollow cylindrical housing which is attached to an internal combustion engine to have a tip thereof facing a combustion chamber; (b) a cylindrical porcelain insulator which is retained inside the housing; (c) a center electrode which is retained inside the porcelain insulator and protrudes from a front end of the porcelain insulator; and (d) an annular ground electrode which is secured to a front end portion of the housing and has an inner peripheral surface facing an outer peripheral surface of the center electrode.

The housing has a shoulder which is formed on an inner peripheral surface of the housing and tapers toward a front end of the housing in an axial direction of the spark plug.

The porcelain insulator includes a mounting shoulder and an insulator nose. The mounting shoulder is formed on an outer periphery of the porcelain insulator and tapers toward a front end of the porcelain insulator in the axial direction of the spark plug. The mounting shoulder rides on the shoulder of the housing to retain the porcelain insulator inside the housing. The insulator nose is located closer to the front end of the porcelain insulator than the mounting shoulder is.

A pocket is created between an outer peripheral surface of the insulator nose and the inner peripheral surface of the housing.

A plurality of vent holes are formed in the front end portion of the housing and located outside the ground electrode in a radial direction of the housing. The vent holes communicate between the pocket and the combustion chamber.

The vent holes include a first vent hole and a second vent hole. The first vent hole has an opening area which is different from an opening area of the second vent hole, as viewed in the axial direction of the spark plug.

The spark plug is, as described above, equipped with the vent holes which communicate between the pocket and the combustion chamber. The vent holes include the first vent hole and the second vent hole which is different in opening area from the first vent hole, thereby resulting in a difference between flow rates of gas flowing from the first vent hole and the second vent hole into the combustion chamber, that is, producing a main flow of gas directed to the first vent hole which is greater in opening area than the second vent hole within the pocket. This creates a swirl flow of the gas which swirls about an axis of the spark plug, thereby facilitating the ease with which the gas in the pocket flows into the combustion chamber through the vent holes, so that the gas remaining in the pocket is minimized. This enhances the scavenging of the pocket, thus minimizing the smoldering to decrease the amount of soot in the combustion chamber.

As apparent from the above discussion, the spark plug for internal combustion engines in this disclosure has an enhanced ability to scavenge the pocket or void space created between the porcelain insulator and the housing.

In this disclosure, symbols in brackets represent correspondence relation between terms in claims and terms described in embodiments which will be discussed later, but are not limited only to parts referred to in the disclosure.

BRIEF DESCRIPTION OF THE DRAWINGS

The present invention will be understood more fully from the detailed description given hereinbelow and from the accompanying drawings of the preferred embodiments of the invention, which, however, should not be taken to limit the invention to the specific embodiments but are for the purpose of explanation and understanding only.

In the drawings.

DESCRIPTION OF THE PREFERRED EMBODIMENTS

First Embodiment

The spark plug 1 for internal combustion engines will be described below with reference to FIGS. 1 to 7.

Figure 1:
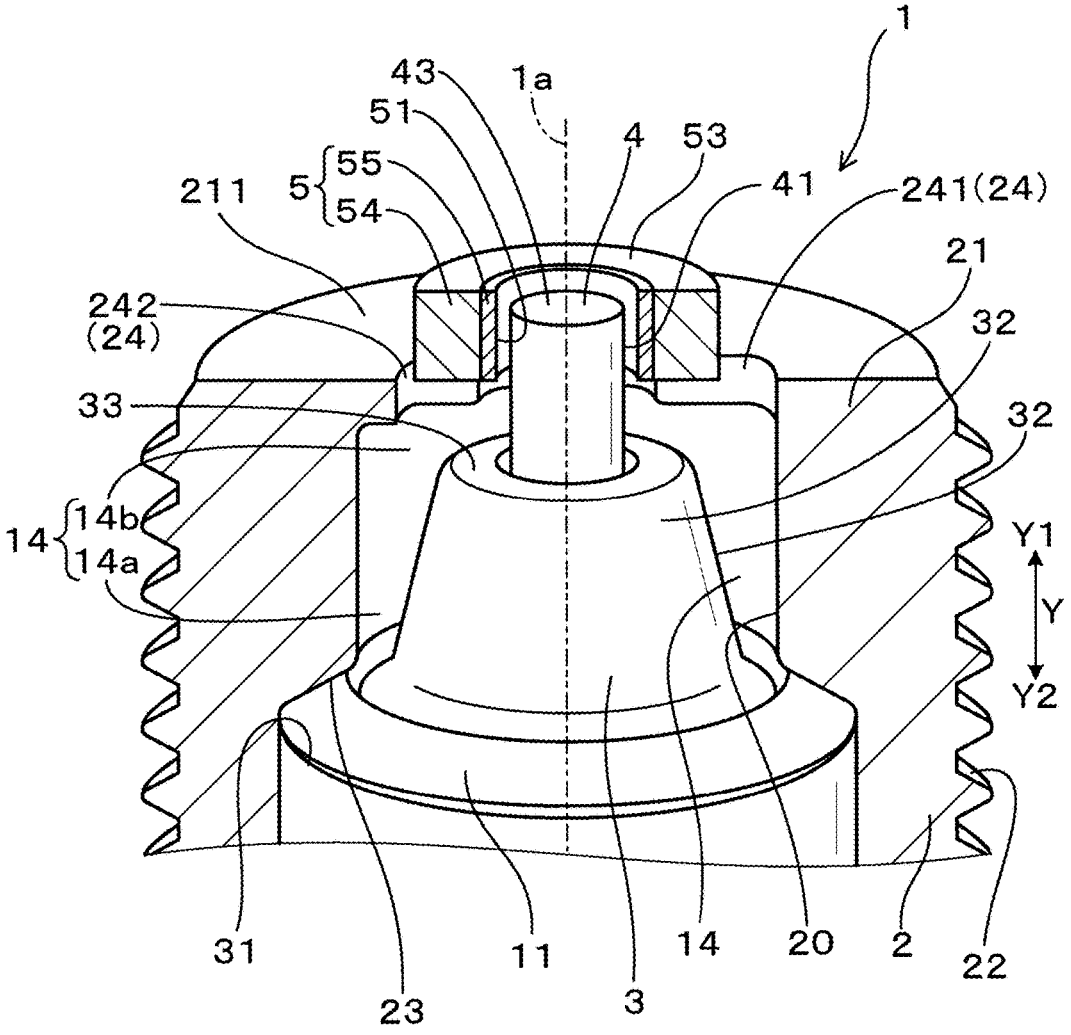
FIG. 1 is an enlarged partially sectional view which illustrates a spark plug according to the first embodiment.

The spark plug 1, as clearly illustrated in FIG. 1, includes the hollow cylindrical housing 2, the porcelain insulator 3, the center electrode 4, and the ground electrode 5.

The housing 2 is installed in the internal combustion engine with a front end (i.e., a head) thereof exposed to the combustion chamber 61.

The porcelain insulator 3 is of a cylindrical shape and retained inside the housing 2.

The center electrode 4 is retained inside the porcelain insulator 3 and partially projects from a front end of the porcelain insulator 3.

The ground electrode 5 is of an annular shape and secured to the front end portion 21 of the housing 2. The ground electrode 5 has the inner peripheral surface 51 facing the outer peripheral surface 41 of the center electrode 4.

In the following discussion, a portion of the spark plug 1 exposed to the combustion chamber 61 of the internal combustion engine will also be referred to as a front end or a front end side Y1, while a portion of the spark plug 1 furthest away from the front end will also be referred to as a base end or a base end side Y2.

The housing 2 has the inner peripheral surface 20 on which the inner shoulder 23 (which will also be referred to below as a seat shoulder) is formed. The inner shoulder 23 tapers toward the front end of the housing 2, in other words, has an inner diameter decreasing from the base end side Y2 toward the front end side Y1 in the axial direction Y of the spark plug 1.

The porcelain insulator 3 has the mounting shoulder 31 formed on an outer periphery thereof. The mounting shoulder 31 is formed on an outer peripheral surface of the porcelain insulator 3 and tapers toward the front end side Y1. The porcelain insulator 3 is retained inside the housing 2 coaxially therewith with the mounting shoulder 21 riding on the inner shoulder 23 of the housing 2 in the axial direction of the spark plug 1. The porcelain insulator 3 also has the insulator nose 32 located closer to the tip or front end thereof (i.e., the front end side Y1) than the mounting shoulder 31 is.

The pocket (i.e., a void space or an air gap) 14 is formed between the outer peripheral surface of the insulator nose 32 and the inner peripheral surface of the housing 2.

The housing 2 has formed in the front end portion 21 a plurality of vent holes 24 which communicate between the pocket 14 and the combustion chamber 61 of the engine. The vent holes 24 are located outside the ground electrode 5 in the radial direction of the housing 2.

Figure 3:
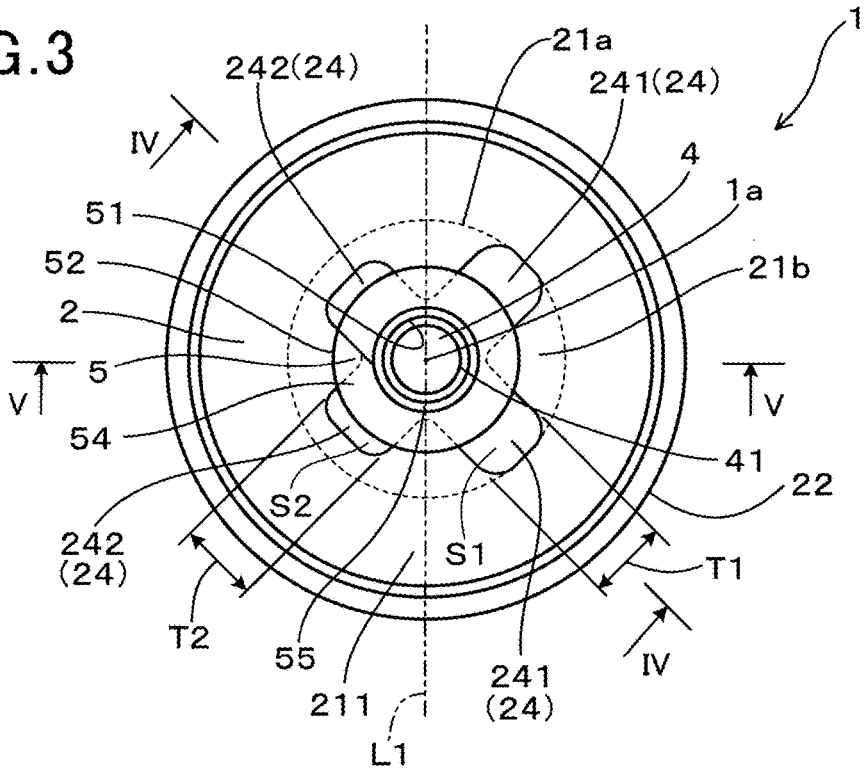
FIG. 3 is a front view which illustrates a front end portion of the spark plug of FIG. 1.

The vent holes 24, as clearly illustrated in FIG. 3, include the first vent holes 241 and the second vent holes 242. The first vent holes 241 are each shaped to have an opening which is exposed to the combustion chamber 61 and different in area than those of the second vent holes 242.

The spark plug 1 for internal combustion engines according to this embodiment will be described below in more detail.

The spark plug 1 is used as an igniter in internal combustion engines mounted in, for example, automotive vehicles or cogeneration systems. In this disclosure, when the spark plug 1 is installed in the internal combustion engine, a portion of the spark plug 1 exposed to the combustion chamber 61 of the internal combustion engine, as already described above, is also referred to as the front end or front end side Y1, while a portion of the spark plug 1 furthest away from the front end will also be referred to as the base end or base end side Y2. A plug axial direction, a plug radial direction, and a plug circumferential direction, as referred to herein, are a lengthwise direction, a radial direction, and a circumferential direction of the spark plug 1, respectively.

Figure 2:
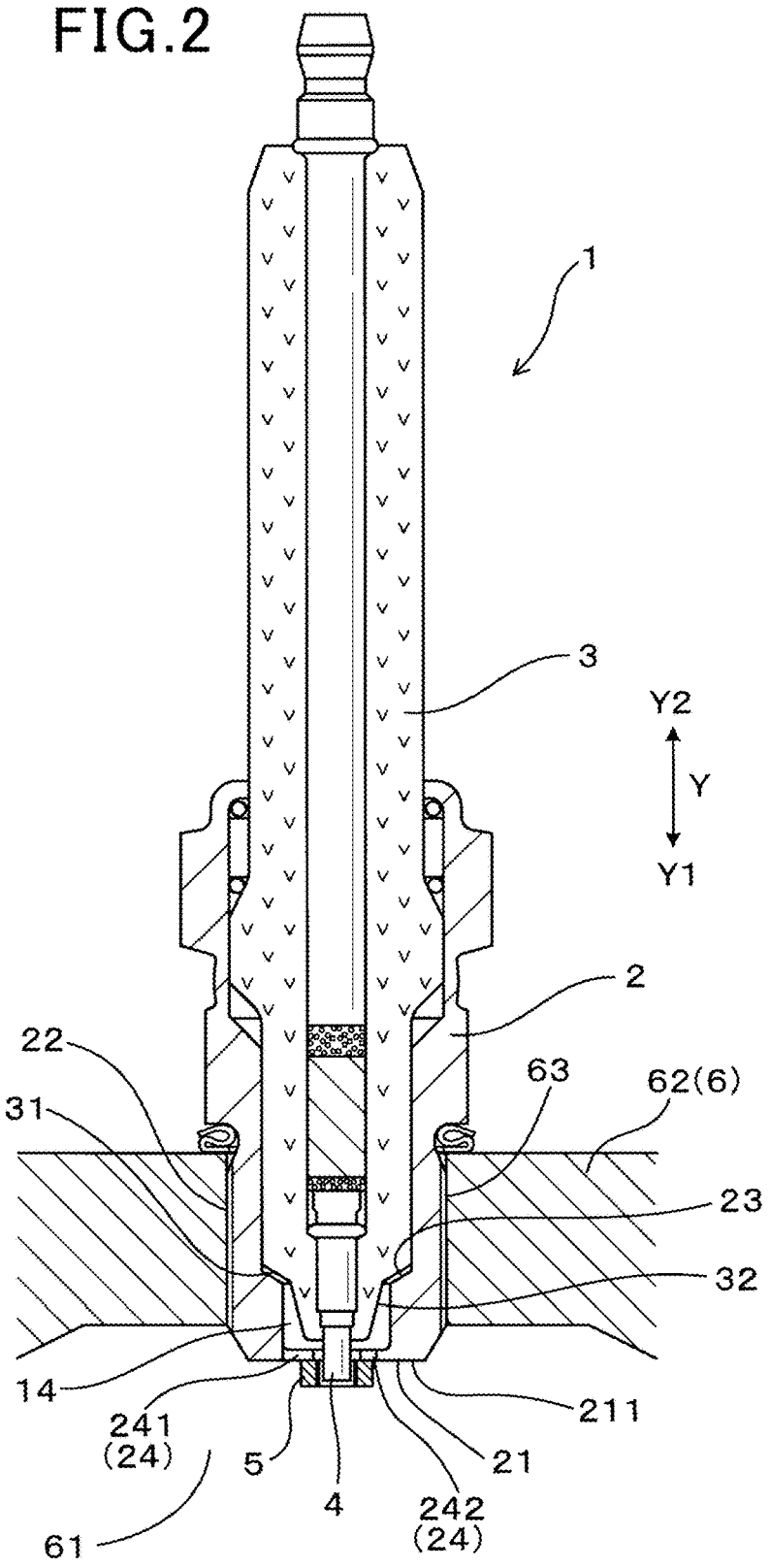
FIG. 2 is a longitudinal sectional view which illustrates a spark plug mounted in an internal combustion engine according to the first embodiment.

The spark plug 1 is, as clearly illustrated in FIG. 2, mounted in the cylinder head 62 of the internal combustion engine 6 with the front end portion 21 of the housing 2 facing the combustion chamber 61 of the internal combustion engine 6. The center electrode 4 is, as illustrated in FIGS. 1 and 3, of a cylindrical shape and arranged coaxially or in alignment with the cylindrical housing 2, the cylindrical porcelain insulator 3, and the cylindrical ground electrode 5 in the lengthwise direction of the spark plug 1.

Figure 4:
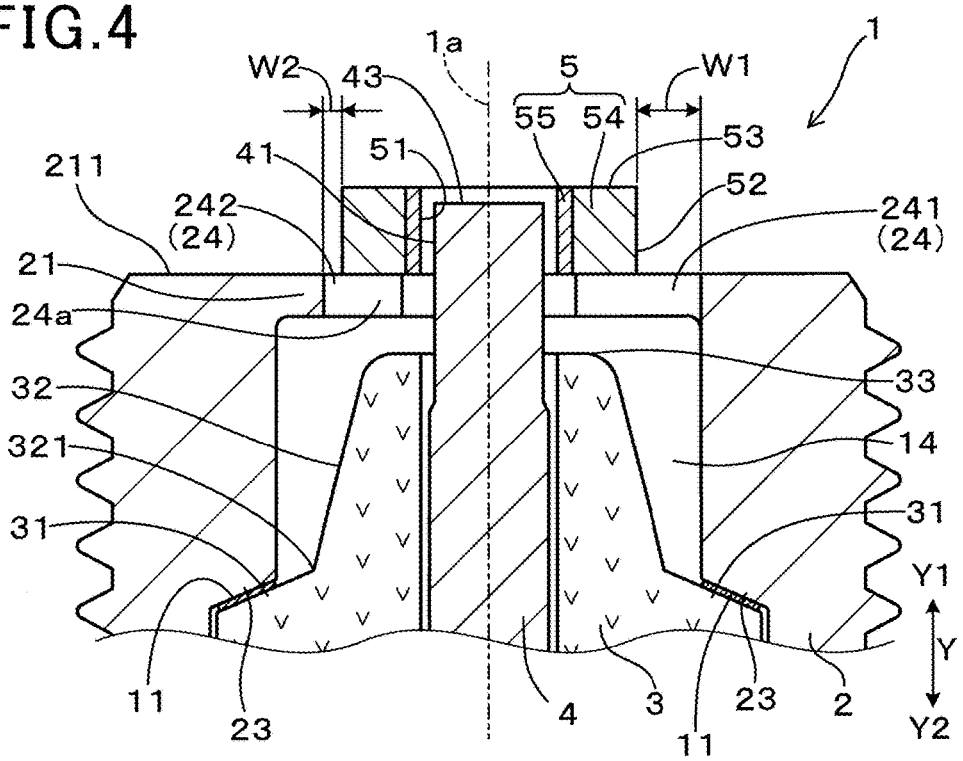
FIG. 4 is a partially longitudinal sectional view taken along the line IV-IV in FIG. 3.

The porcelain insulator 3 is, as illustrated in FIG. 2, of a cylindrical shape and, as illustrated in FIGS. 1 and 4, has the mounting shoulder 31 which tapers toward the base end 321 of the insulator nose 32. In other words, the mounting shoulder 31 has a diameter increasing toward the base end side Y2. The housing 2 has formed on the inner peripheral wall thereof the tapered seat shoulder 23 which has a diameter increasing toward the base end side Y2. The seat shoulder 23 and the mounting shoulder 31 are placed in contact with each other through the annular packing (also called a gasket) 11, thereby aligning the porcelain insulator 3 with the housing 2 in the plug axial direction. The insulator nose 32 which is located closer to the tip of the spark plug 1 than the packing 11 is defines the pocket 14 between itself and the inner periphery of the housing 2.

Each of the vent holes 24 formed in the housing 2, as illustrated in FIG. 1, has an end opening to the pocket 14, so that the pocket 14 communicates with the combustion chamber 61 through the vent holes 24 when the spark plug 1 is installed in the internal combustion engine 6. The vent holes 24 also open at the front end surface 211 of the small-diameter portion 21. The vent holes 24, as clearly illustrated in FIG. 4, extend parallel in the plug axial direction Y.

The vent hole 24 are, as clearly illustrated in FIG. 3, arranged at equal angular intervals away from each other in the plug circumferential direction. In this embodiment, the four vent holes 24 are arrayed at equal angular intervals away from each other. Specifically, the vent holes 24, as described already, include the two first vent holes 241 and the two second vent holes 242. Each of the first vent holes 241, as illustrated in FIG. 3, has a first opening area S1. Each of the second vent holes 242 has a second opening area S2. The first opening area S1 is greater than the second opening area S2. In this embodiment, the first opening area S1 is the greatest in the vent holes 24. The second opening area S2 is the smallest in the vent holes 24. The opening areas S1 and S2 of the vent holes 24 are areas of the openings of the vent holes 24, as viewed from the front end side Y1 in the plug axial direction Y. In this embodiment, the opening areas S1 and S2 are represented by areas of openings in the front end surface 211 of the housing 2.

A ratio (which will also be referred to as an opening area ratio) of the opening area S2 to the opening area S1 (i.e., S2/S1) is preferably selected to be 0.1 or more and 0.9 or less, and more preferably 0.2 or more and 0.8 or less. When the opening area ratio (i.e., S2/S1) is less than 0.1, there is a risk that the amount of gas emitted from the second vent holes 242 is small, so that most of the gas is discharged from the first vent holes 241, thus resulting in less generation of swirl flows of the gas in the pocket 14, which leads to insufficient scavenging of the pocket 14. Alternatively, when the opening area ratio is greater than 0.9, in other words, the opening area ratio is close to 1, it results in a small difference in opening area between the first vent holes 241 and the second vent holes 242. This results in a decreased difference in discharged amount of gas between the first vent holes 241 and the second vent holes 242, thereby leading to less generation of swirl flows of the gas in the pocket 14, i.e., insufficient scavenging of the pocket 14.

A total opening area SO of the vent holes 24 is not limited to a specific value, but may be determined as a function of an area of the annular region 21*b* on the front end surface 211 of the housing 2, as illustrated in FIG. 3, where the vent holes 24 are formed. In the example of FIG. 3, the annular region 21*b* is defined, as viewed in the plug axial direction Y, between the circle 21*a* whose center is on the axis of the spark plug 1 and the outer peripheral surface 52 of the ground electrode 5. The annular region 21*b* is selected to be 35 $mm^2$. In this case, the total opening area SO is preferably selected to be 1.0 $mm^2$ or more, and more preferably 4.0 $mm^2$ or more. When the total opening area SO is selected to be less than 1.0 $mm^2$, it results in insufficient amount of the gas discharged from the vent holes 24 to scavenge the pocket 14.

The configuration of the vent holes 24 is not limited to a specific shape. In the example of FIG. 3, the first vent holes 241 and the second vent holes 242 are each designed in the form of a rectangular shape with radially outside corners rounded, as viewed in the plug axial direction Y. The long side of the rectangular shape extends substantially in the circumferential direction of the spark plug 1. Specifically, each of the first vent holes 241, as illustrated in FIG. 3, has a length T1 in a direction perpendicular to the radial direction of the spark plug 1. Each of the second vent holes 242 has a length T2 in a direction perpendicular to the radial direction of the spark plug 1. The length T1 and the length T2 are selected to be equal to each other. Each of the second vent holes 242, as illustrated in FIG. 4, has a width W2 that is a dimension in the radial direction of the spark plug 1. Each of the first vent holes 241 has a width W1. The width W2 is shorter than the width W1. This results in the opening area S2 of the second vent holes 242 being smaller than the opening area S1 of the first vent holes 241.

Each of the first vent holes 241 and one of the second vent holes 242 are, as viewed in the plug axial direction Y in FIG. 3, arranged to be point-symmetrical with respect to the plug axis 1*a*. The vent holes 24 are broken down into two groups located on opposite sides of an imaginary line L1 defined to traverse the axis of the spark plug 1 (i.e., the plug axis 1*a*). Specifically, the two first vent holes 241 are arranged in a first region (i.e., the right side of the line L1 in FIG. 3), while the two second vent holes 242 are arranged in a second region (i.e., the left side of the line L1).

The housing 2, as clearly illustrated in FIG. 4, has the through-holes 24*a* formed in the front end portion 2. Each of the holes 24*a* is partially covered with the ground electrode 5 disposed on the front end portion 21 of the housing 2. The holes 24*a*, therefore, have portions which are uncovered with the ground electrode 5 and define the vent holes 24.

The housing 2, as illustrated in FIG. 1, has formed on the outer periphery thereof the attachment screw 22 for mounting the spark plug 1 in the threaded mounting hole 63 formed in the engine head 62 of the internal combustion engine 6. The housing 2 is made of, for example, Fe-based alloy.

The ground electrode 5, as illustrated in FIG. 1, includes the annular main electrode body 54 and the noble metal layer 55 formed on an inner peripheral surface of the main electrode body 54. The main electrode body 54 is made of, for example, Ni-based alloy. The noble metal layer 55 is made of, for example, platinum (Pt) or Iridium (Ir) or an alloy thereof. The noble metal layer 55 is diffusion-bonded to the main electrode body 54. The noble metal layer 55 has a thickness of, for example, 0.1 mm to 0.5 mm. The ground electrode 5 is, as described above, made up of two parts: the main electrode body 54 and the noble metal layer 55 in order to enhance the wear-resistance of the ground electrode 5 to increase the service life of the spark plug 1. The ground electrode 5 has the front end surface 53 located away from the front end surface 43 of the center electrode 4 outward in the axial direction of the spark plug 1.

Gas Flow Analysis 1

Figure 5:
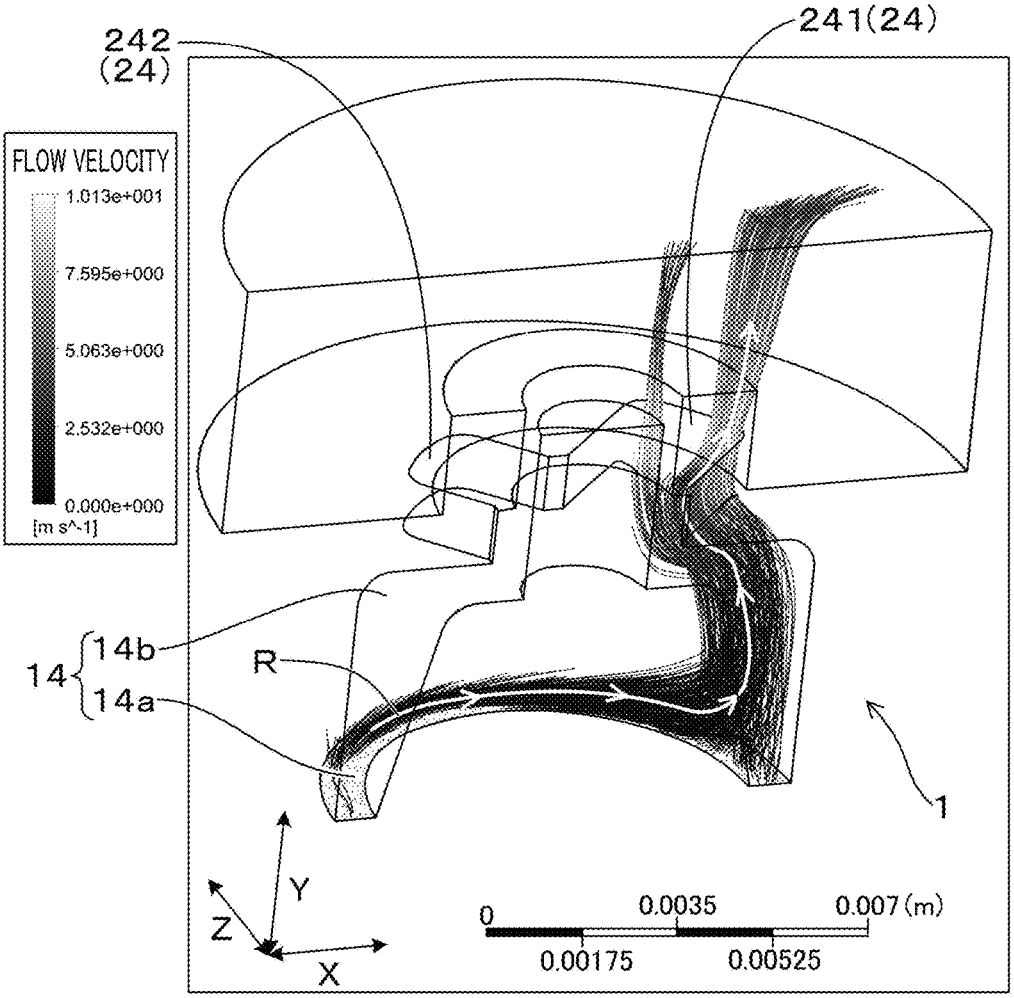
FIG. 5 is a partially longitudinal sectional view taken along the line IV-IV in FIG. 3 which demonstrates gas flow analysis 1 in the spark plug of FIG. 1.
Figure 6:
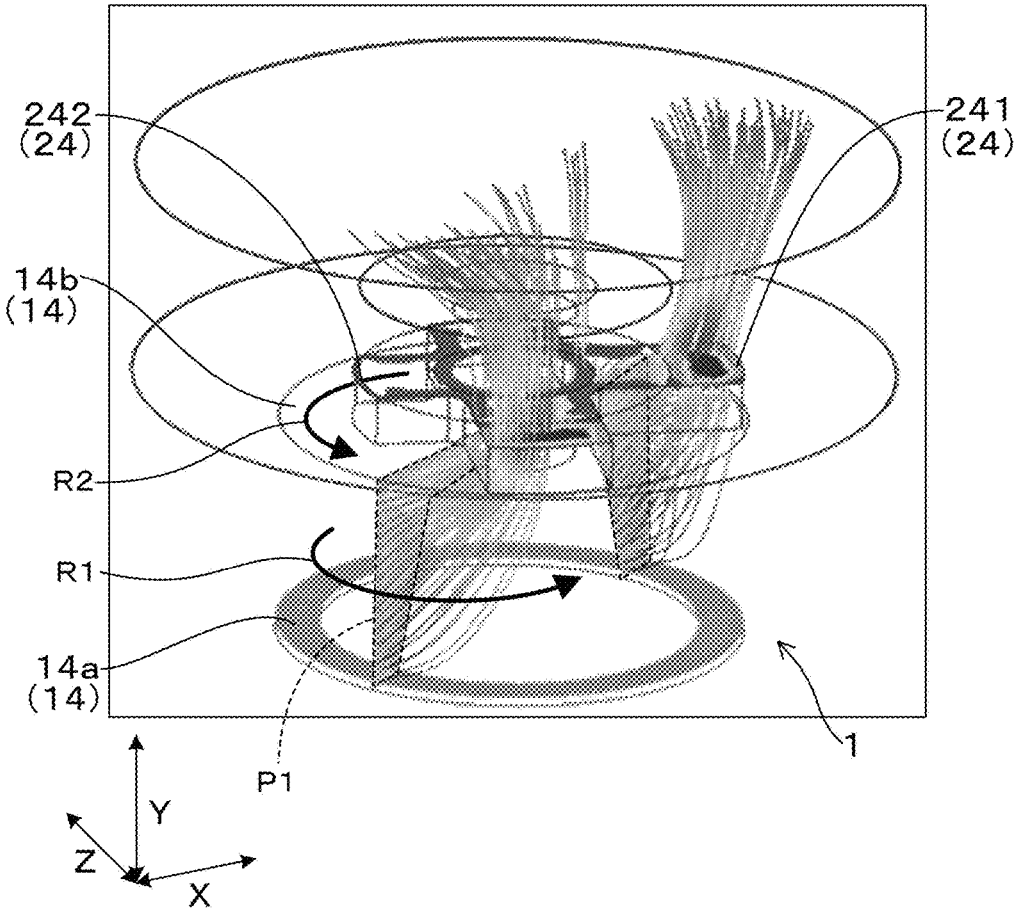
FIG. 6 is a partially longitudinal sectional view taken along the line IV-IV in FIG. 3 which demonstrates gas flow analysis 2 in the spark plug of FIG. 1.

The gas flow analysis 1 was made by performing gas flow simulations on the spark plug 1 in the first embodiment. Specifically, the gas flow simulations were made in a test condition where a negative pressure of 1 m/s was applied to the front end Y1 of the spark plug 1 to simulate a condition in the internal combustion engine during an exhaust stroke. Results of the simulations of flows and flow rates of gas discharged from the pocket 14 are represented in FIG. 5. FIG. 5 shows that a swirl flow R is created by gas in the region 14*a* close to the base end side Y2 within the pocket 14 which moves toward the first vent hole 241 while swirling.

Gas Flow Analysis 2

Figure 7:
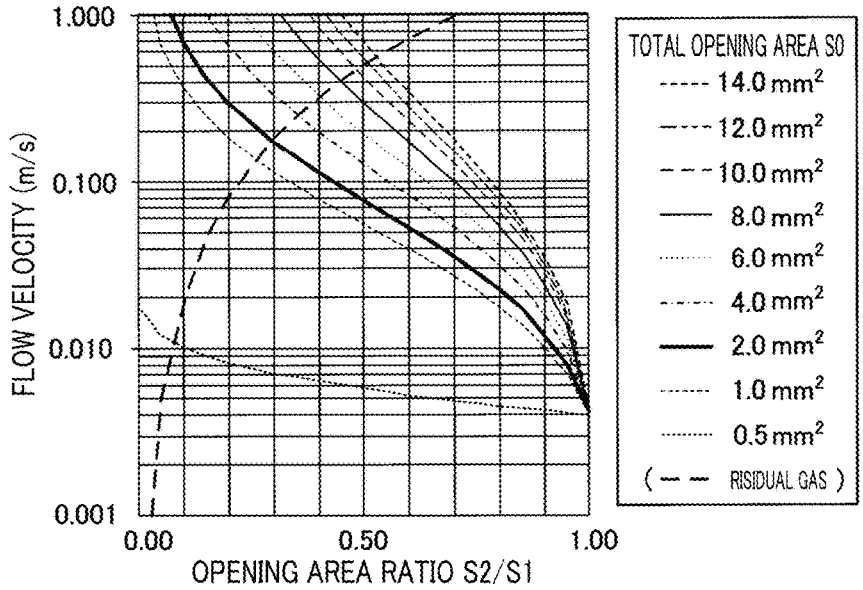
FIG. 7 is a graph which represents results of gas flow simulations in the first embodiment.

Next, the gas flow analysis 2 was made by performing gas flow simulations on the spark plug 1. Specifically, the gas flow simulations were, as demonstrated in FIG. 6, made to analyze flow velocities of the gas flow R1 and the gas flow R2 on the sectional area P defined to extend parallel to the plug axial direction Y within the pocket 14. The gas flow R1 is in the region 14*a* closer to the base end side Y2 within the pocket 14. The gas flow R2 is in the region 14*b* closer to the front end side Y1 within the pocket 14. Results of the simulations to measure the velocities of the gas flows R1 and R2 for different values of the total opening area SO in a range of 0.5 $mm^2$ to 14 $mm^2$ in the spark plug 1 of the first embodiment are represented in FIG. 7. "Residual gas" in FIG. 7 indicates the velocity of the gas flow R2 in FIG. 6.

FIG. 7 shows that when the total opening area SO is 0.5 $mm^2$, the velocity of a swirl flow in the pocket 14 is low meaning an insufficient velocity, while when the total opening area SO is 1.0 $mm^2$ or more, the velocity of the swirl flow in the pocket 14 is high meaning a sufficient velocity. Such a swirl flow is thought of as agitating residual gas within the pocket 14 to discharge gas which remains in the region 14*a* close to the base end side Y2 within the pocket 14 and is difficult to fully scavenge by gas flows oriented in the plug axial direction Y, thereby enhancing the scavenging of the pocket 14. The gas flow R2, as indicated by "residual gas" in FIG. 7, is increased with an increase in the opening area ratio S2/S1. This means that when the gas flow R2 in the region 14*b* is increased with a relative increase in size of the second vent holes 242.

Evaluation Test 1

The evaluation test 1 was performed in the following way. Specifically, test samples were prepared which have substantially the same structure as that of the spark plug 1 in the first embodiment 1 and the total opening area SO and the opening are ratio (S2/S1) have values listed in table 1. The evaluation test 1 was performed in a rated condition where an internal combustion engine in which each of the test samples is installed is operated at 1500 rpm for one hour, after which an insulation resistance of the porcelain insulator 3 of each test sample is measured or evaluated. When the insulation resistance is 100 MΩ or more, the test sample is evaluated as being very good (VG). When the insulation resistance is 10 MΩ or more and less than 100 MΩ, the test sample is evaluated as being good (G). When the insulation resistance is less than 10 MΩ, the test sample is evaluated as being bad (B). These evaluation values are represented in the table 1.

In the table 1 below, the opening area ratio (S2/S1) of 0.0 means the structure without the second vent holes 242 shown in FIG. 3. The opening area ratio (S2/S1) of 1.0 means the structure equipped with the first vent holes 241 instead of the second vent holes 242 shown in FIG. 3. Note that both the above structures are not equipped with vent holes different in size from each other.

TABLE 1

| Total opening | Opening area ratio (S2/S1) | | | | | | |
|---|---|---|---|---|---|---|---|
| area SO $mm^2$ | 0.0 | 0.05 | 0.2 | 0.5 | 0.8 | 0.9 | 1.0 |
| 10.0 | B | B | G | VB | VG | G | B |
| 4.0 | B | B | G | VB | VB | G | B |
| 1.0 | B | B | G | G | G | G | B |
| 0.5 | B | B | B | B | B | B | B |

The table 1 shows that the total opening area SO is preferably selected to be 1.0 $mm^2$ to 10.0 $mm^2$, and more preferably 4.0 $mm^2$ to 10.0 $mm^2$ and that the opening area ratio (S2/S1) is preferably selected to be 0.2 to 0.9, and more preferably 0.5 to 0.8.

The spark plug 1 in this embodiment offers the following beneficial advantages.

The spark plug 1 is, as described above, equipped with the vent holes 24 which communicate between the pocket 14 and the combustion chamber 61. The vent holes 24 include the first vent holes 241 and the second vent holes 242 which are different in opening area from the first vent holes 241, thereby resulting in a difference between flow rates of gas flowing from the first vent holes 241 and the second vent holes 242 into the combustion chamber 61, that is, producing a main flow of the gas directed to the first vent holes 241 which are greater in opening area than the second vent holes 242 within the pocket 14. This creates the swirl flow R of the gas which swirls about the axis 1*a* of the spark plug 1, thereby facilitating the ease with which the gas in the pocket 15 flows into the combustion chamber 61 through the vent holes 24, so that the gas remaining in the pocket 14 is minimized. This enhances the scavenging of the pocket 14, thus minimizing the smoldering to decrease the amount of soot in the combustion chamber 61.

The first vent holes 241 have the greatest opening area S1 in the vent holes 24. The ratio of the opening area S2 of the second vent holes 242 to the opening area S1 of the first vent holes 241 is selected to be 0.9 or less. This produces a desirable swirl flow of gas in the pocket 14 to enhance the scavenging of the pocket 14.

The ratio of the opening area S2 of the second vent holes 242 to the opening area S1 of the first vent holes 241 may be selected to be 0.1 or less. This also produces a desirable swirl flow of gas in the pocket 14 to enhance the scavenging of the pocket 14.

The total opening area SO of the vent holes 24 is selected to be 1 $mm^2$ or more. This produces a desirable amount of gas discharged from the vent holes 24 to achieve a required degree of scavenging of the pocket 14.

Each of the first vent holes 241 and one of the second vent holes 242 are arranged to be symmetrical with respect to the center electrode 4, as viewed in the plug axial direction Y. This facilitates generation of the swirl flow R oriented from the second vent holes 242 to the first vent holes 241, thereby improving the scavenging of the pocket 14.

The second vent holes 242 are each shaped to have a width in the radial direction of the spark plug 1 which is smaller than those of the first vent holes 241, so that the opening are S2 of the second vent holes 242 is smaller than the opening area S1 of the first vent holes 241, thereby enhancing the efficiency in scavenging the pocket 14.

As apparent from the above discussion, the spark plug 1 has an enhanced ability to scavenge the pocket 14 created between the porcelain insulator 3 and the housing 2.

Figure 8:
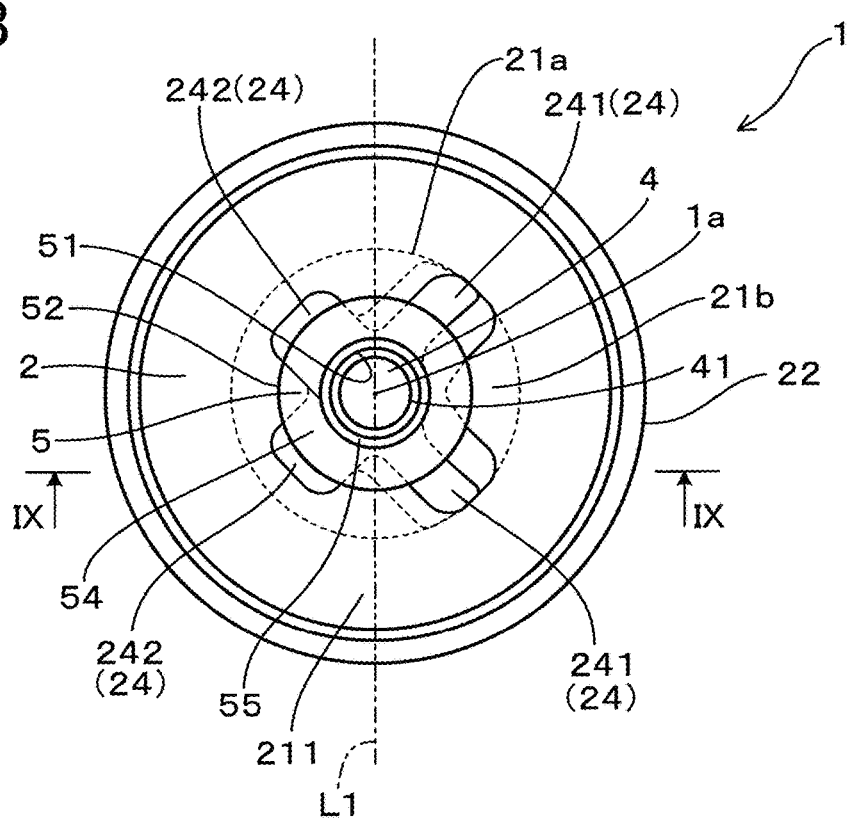
FIG. 8 is a front view which illustrates a front end portion of a spark plug according to a first modification.
Figure 9:
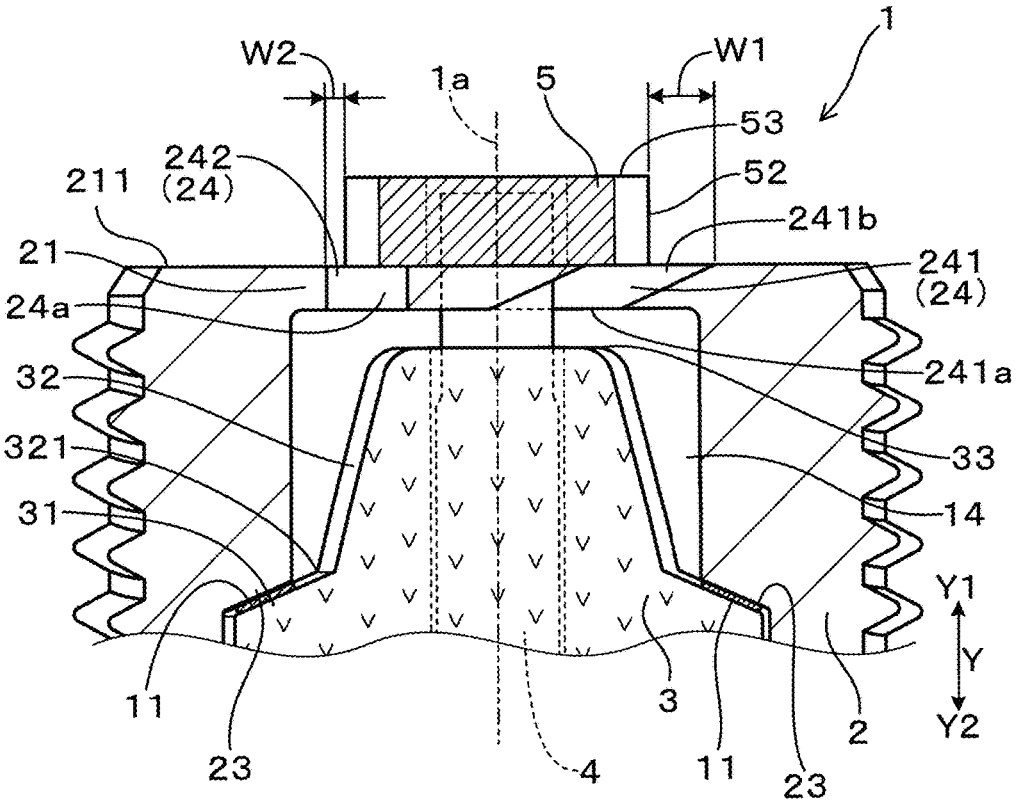
FIG. 9 is a partially longitudinal sectional view taken along the line IX-IX in FIG. 8.

The first vent holes 241, as clearly illustrated in FIG. 3, extend from the pocket 14 toward the combustion chamber 61 parallel to the plug axial direction Y, but instead, the first vent holes 241 and the second vent holes 242 may be, as illustrated in FIGS. 8 and 9, arranged adjacent each other in the circumferential direction of the housing 2. Each of the first vent holes 241 has the first opening 241*a* and the second opening 241*b*. The first opening 241*a* is closer to the pocket 14 than the second opening 241*b* is. The second opening 241*b* faces the combustion chamber 61. Each of the first vent holes 241 is inclined relative to the axis 1*a* of the spark plug 1 (i.e., the plug axial direction Y) to have the first opening 241*a* which is arranged closer to an adjacent one of the second vent holes 242 than the second opening 241*b* is. Other arrangement of the spark plug 1 in this modified form are identical with those in the first embodiment.

The first modification illustrated in FIGS. 8 and 9 offers substantially the same beneficial advantages as those in the first embodiment. The inclination of the first vent holes 241 is selected to align the orientation of the swirl flow R in the pocket 14 with the longitudinal center line of each of the first vent holes 241, thereby enhancing the efficiency in scavenging the pocket 14.

Figure 10A:
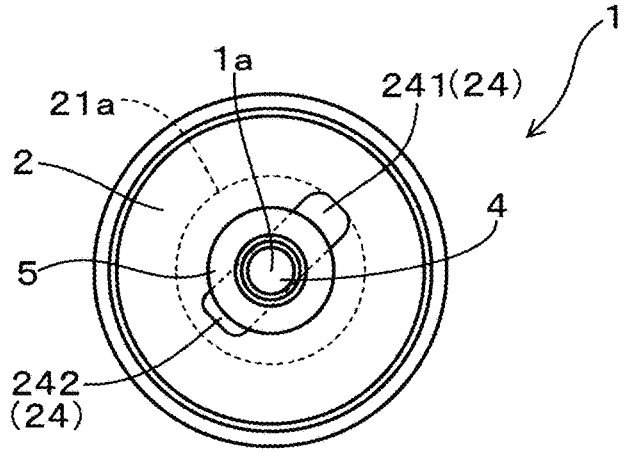
FIGS. 10(*a*) to 10(*c*) are front views which illustrate second to fourth modifications of a spark plug.
Figure 10B:
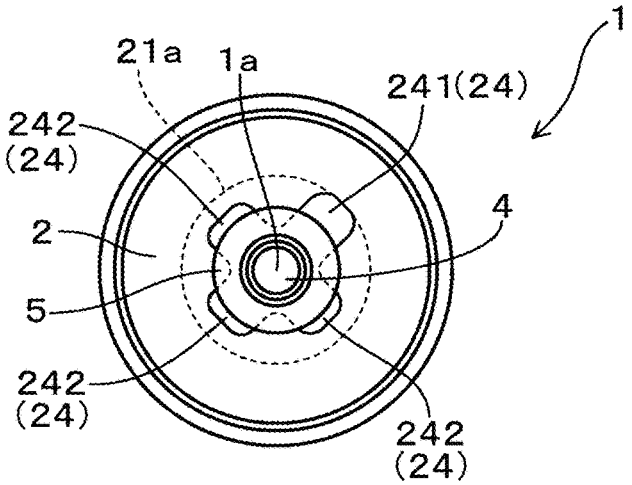
Figure 10C:
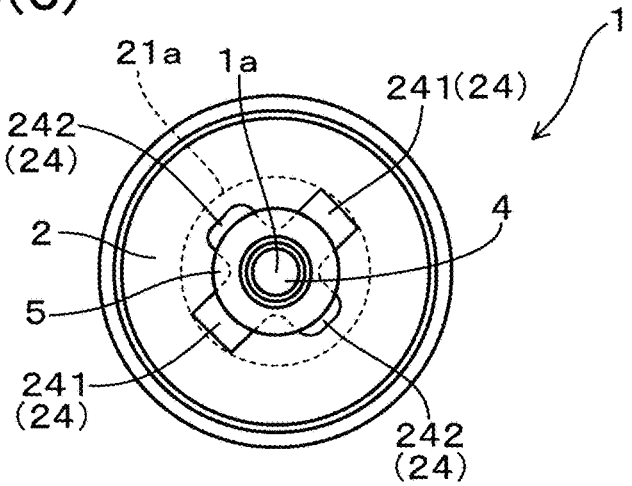
Figure 11A:
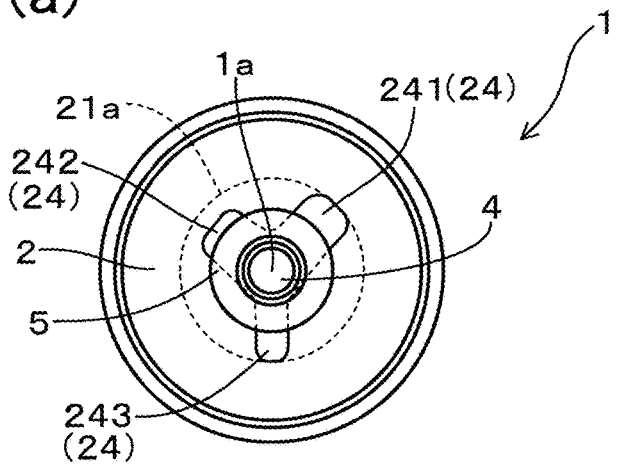
FIGS. 11(*a*) to 11(*c*) are front views which illustrate fifth to seventh modifications of a spark plug.
Figure 11B:
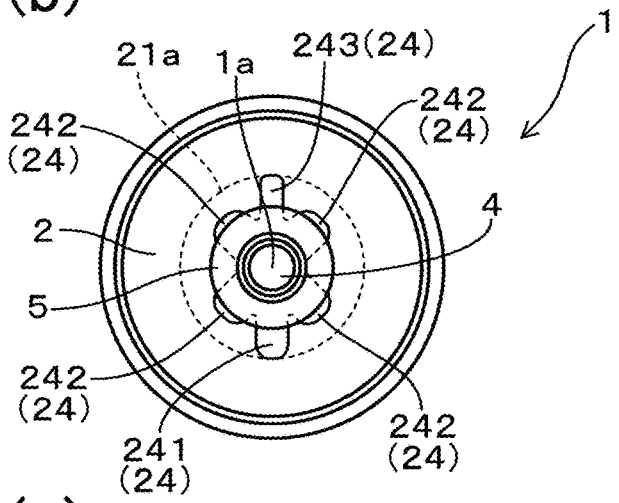
Figure 11C:
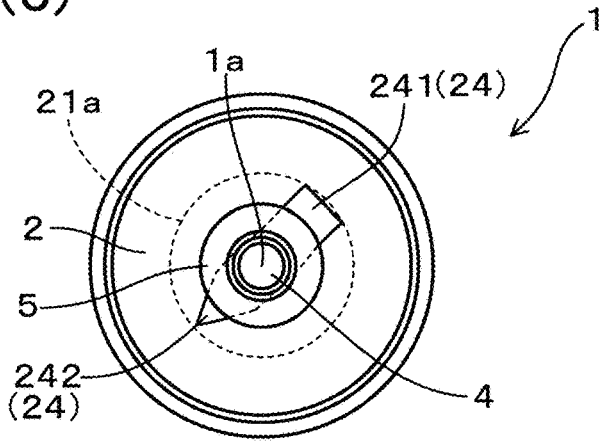

The configuration of the first vent holes 241 and the second vent holes 242 is not limited to the one described in the first embodiment, but may be designed to have one of shapes illustrated in FIGS. 10(*a*) to 10(*c*) and FIGS. 11(*a*) to 11(*c*).

Specifically, in the second modification illustrated in FIG. 10(*a*), the housing 2 is equipped with a single first vent hole 241 and a single second vent hole 242 which are located point-symmetrically with respect to the axis 1*a* of the spark plug 1, as viewed in the plug axial direction Y.

In the third modification illustrated in FIG. 10(*b*), the housing 2 is equipped with three second vent holes 242 and a single first vent hole 241. The second vent holes 242 and the first vent hole 241 have the same structures as those in FIG. 3.

In the fourth modification illustrated in FIG. 10(*c*), the housing 2 is equipped with two vent holes 241 arranged point-symmetrically about the axis 1*a* of the spark plug 1 and two second vent holes 242 arranged point-symmetrically about the axis 1*a* of the spark plug 1, as viewed in the plug axial direction Y. Each of the first vent holes 241 are shaped to have non-rounded sharp or right-angled corners.

In the fifth modification illustrated in FIG. 11(*a*), the housing 2 is equipped with a single first vent hole 241, a single second vent hole 242, and a third vent hole 243. The third vent hole 243 has an opening area which is smaller than the opening area S1 of the first vent hole 241 and greater than the opening area S2 of the second vent hole 242. The first vent holes 241, the second vent holes 242, and the third vent hole 243 are arranged at equal intervals away from each other in the circumferential direction of the housing 2. The structure of the housing 2 facilitates production of a swirl flow of gas within the pocket 14 which swirls from the second vent hole 242 to the third vent hole 243 and then to the first vent hole 241, as viewed in the plug axial direction Y, thereby enhancing the ability of the housing 2 to scavenge the pocket 14.

In the sixth modification illustrated in FIG. 11(*b*), the housing 2 is equipped with a single first vent hole 241, four second vent holes 242, and a single third vent hole 243. The first vent hole 241 and the third vent hole 243 are arranged point-symmetrically with respect to the axis 1*a* of the spark plug 1. The second vent holes 242 are arranged with two in each interval between the first vent hole 241 and the third vent hole 243 in the circumferential direction of the spark plug 1.

In the seventh modification illustrated in FIG. 11(*c*), the housing 2 is equipped with a single first vent hole 241 and a single second vent hole 242 which are located point-symmetrically with respect to the axis 1*a* of the spark plug 1. The second vent hole 242 has an opening of a triangular shape.

Figure 12A:
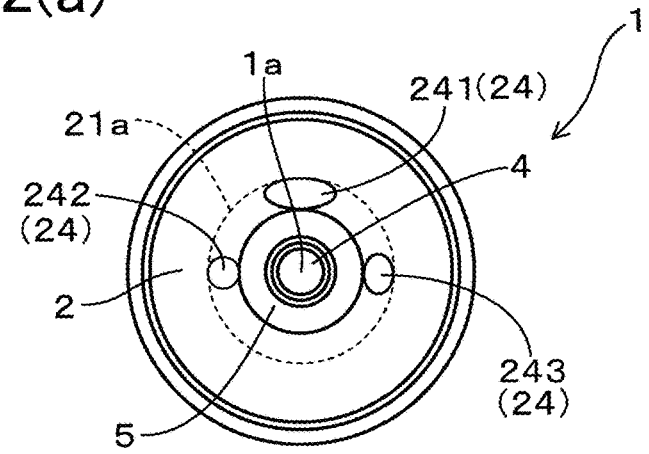
FIGS. 12(*a*) to 12(*c*) are front views which illustrate eighth to tenth modifications of a spark plug.
Figure 12B:
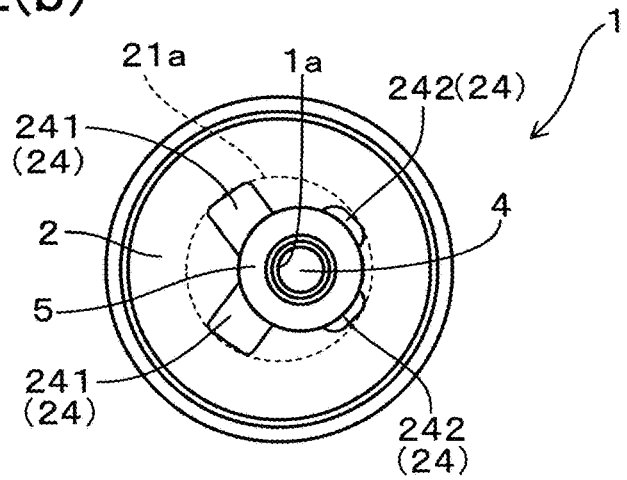
Figure 12C:
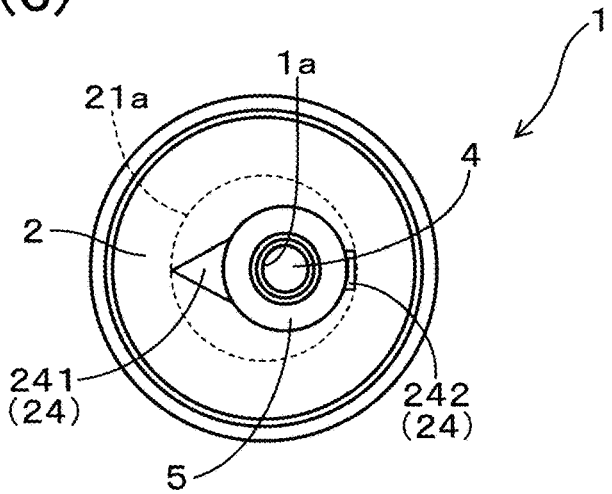

The housing 2 may also be modified as illustrated in FIGS. 12(*a*) to 12(*c*).

Specifically, in the eighth modification illustrated in FIG. 12(*a*), the housing 2 is equipped with a single first vent hole 241, a single second vent hole 242, and a single third vent hole 243. The first vent hole 241 and the third vent hole 243 each have an oval opening. The second vent hole 242 has a circular opening. The second vent hole 242, the first vent hole 241, and the third vent hole 243 are arranged in this order in the circumferential direction of the housing 2. An interval between the second vent hole 242 and the third vent hole 243 in the circumferential direction of the housing 2 (i.e., the spark plug 1) is greater than that between the first vent hole 241 and the second vent hole 242 and between the first vent hole 241 and the third vent hole 243 in the circumferential direction of the housing 2.

In the ninth modification illustrated in FIG. 12(*b*), the center electrode 4 is arranged eccentrically with respect to the axis 1*a* of the spark plug 1. The housing 2 is equipped with two first vent holes 241 and two second vent holes 242. The first vent holes 241 are located closer to the axis 1*a*, while the second vent holes 242 are located farther away from the axis 1*a*.

In the tenth modification illustrated in FIG. 12(*c*), the center electrode 4 is located eccentrically with respect to the axis 1*a* of the spark plug 1. The housing 2 is equipped with a single first vent hole 241 and a second vent hole 242. The first vent hole 241 is located closer to the axis 1*a* of the spark plug 1, while the second vent hole 242 is located farther away from the axis 1*a*. The first vent hole 241 has a triangular opening. The second vent hole 242 has a rectangular opening.

The above second to tenth modifications offer substantially the same beneficial advantages as those in the first embodiment.

While the present invention has been disclosed in terms of the preferred embodiments in order to facilitate better understanding thereof, it should be appreciated that the invention can be embodied in various ways without departing from the principle of the invention. Therefore, the invention should be understood to include all possible embodiments and modifications to the shown embodiments which can be embodied without departing from the principle of the invention as set forth in the appended claims.

What is claimed is:

1. A spark plug for an internal combustion engine comprising:

a hollow cylindrical housing which is attached to an internal combustion engine to have a tip thereof facing a combustion chamber;

a cylindrical porcelain insulator which is retained inside the housing;

a center electrode which is retained inside the porcelain insulator and protrudes from a front end of the porcelain insulator; and an annular ground electrode which is secured to a front end portion of the housing and has an inner peripheral surface facing an outer peripheral surface of the center electrode, wherein the housing has a shoulder which is formed on an inner peripheral surface of the housing and tapers toward a front end of the housing in an axial direction of the spark plug, wherein the porcelain insulator includes a mounting shoulder and an insulator nose, the mounting shoulder being formed on an outer periphery of the porcelain insulator and tapering toward a front end of the porcelain insulator in the axial direction of the spark plug, the mounting shoulder riding on the shoulder of the housing to retain the porcelain insulator inside the housing, the insulator nose being located closer to the front end of the porcelain insulator than the mounting shoulder is, wherein a pocket is created between an outer peripheral surface of the insulator nose and the inner peripheral surface of the housing, wherein a plurality of vent holes are formed in the front end portion of the housing and located outside the ground electrode in a radial direction of the housing, the vent holes communicating between the pocket and the combustion chamber, and wherein the vent holes include a first vent hole and a second vent hole, the first vent hole having an opening area which is different in size from an opening area of the second vent hole, as viewed in the axial direction of the spark plug.

2. A spark plug for an internal combustion engine as set forth in claim 1, wherein the opening area of the first vent hole is greater than that of the second vent hole, a ratio of the opening area of the second vent hole to the opening area of the first vent hole being selected to be 0.9 or less.

3. A spark plug for an internal combustion engine as set forth in claim 1, wherein the opening area of the first vent hole is greater than that of the second vent hole, a ratio of the opening area of the second vent hole to the opening area of the first vent hole being selected to be 0.1 or more.

4. A spark plug for an internal combustion engine as set forth in claim 1, wherein a total opening area of the vent holes is 1 $mm^2$ or more.

5. A spark plug for an internal combustion engine as set forth in claim 1, wherein the first vent hole and the second vent hole are arranged symmetrically with respect to the center electrode, as viewed in the axial direction of the spark plug.

6. A spark plug for an internal combustion engine as set forth in claim 1, wherein the first vent hole and the second vent hole are arranged adjacent each other in a circumferential direction of the housing, and wherein the first vent hole having a first opening closer to the pocket and a second opening closer to the combustion chamber, the first vent hole being inclined relative to the axial direction of the spark plug to have the first opening located closer to the second vent hole than the second opening is.

7. A spark plug for an internal combustion engine as set forth in claim 1, wherein the second vent hole has a dimension in the radial direction of the spark plug which is shorter than that of the first vent hole, as viewed in the axial direction of the spark plug.

* * * * *